United States Patent [19]

Hotz

[11] Patent Number: 4,836,747

[45] Date of Patent: Jun. 6, 1989

[54] ADJUSTING DEVICE FOR A COMPRESSOR

[75] Inventor: Stephan Hotz, Limburgerhof, Fed. Rep. of Germany

[73] Assignee: Aktiengesellschaft Kuehnle, Kopp & Kausch, Frankenthal, Fed. Rep. of Germany

[21] Appl. No.: 215,483

[22] Filed: Jul. 6, 1988

[30] Foreign Application Priority Data

Jul. 6, 1987 [DE] Fed. Rep. of Germany ..... 3722253

[51] Int. Cl.[4] ..... F01D 17/12; F04D 15/00

[52] U.S. Cl. ..... 415/163; 415/150; 415/160; 415/164; 415/148

[58] Field of Search ..... 415/164, 163, 160, 150, 415/148

[56] References Cited

U.S. PATENT DOCUMENTS

| | | | |
|---|---|---|---|
| 1,989,413 | 1/1935 | Hagen | 415/160 |
| 3,056,541 | 10/1962 | Foweraker | 230/114 |
| 3,069,070 | 12/1962 | Macaluso et al. | 415/148 |

FOREIGN PATENT DOCUMENTS

| | | | |
|---|---|---|---|
| 0043017 | 1/1982 | European Pat. Off. . | |
| 2403113 | 8/1975 | Fed. Rep. of Germany . | |
| 1337456 | 5/1963 | France | 415/163 |
| 517254 | 12/1971 | Switzerland . | |
| 578034 | 3/1945 | United Kingdom | 415/163 |
| 817013 | 7/1959 | United Kingdom . | |
| 1322888 | 7/1973 | United Kingdom | 415/160 |

OTHER PUBLICATIONS

Patent Abstracts of Japan, vol. 10, No. 47, (M-456)[2104], Feb. 25, 1986.

Patent Abstracts of Japan, vol. 11, No. 333, (M-637)[2780], Oct. 30, 1987.

*Primary Examiner*—Robert E. Garrett
*Assistant Examiner*—Michael V. Readey
*Attorney, Agent, or Firm*—Foley & Lardner, Schwartz, Jeffery, Schwaab, Mack, Blumenthal & Evans

[57] ABSTRACT

An adjusting device of a compressor includes guide vanes (2) arranged in the form of a ring around a longitudinal axis (4), which vanes are in each case connected fixedly in terms of rotation to pivot pins (8) and are pivotally mounted in the housing (46). Two-armed cranks (10) are connected fixedly in terms of rotation to the pivot pins (8), cranks (10) neighboring each other in circumferential direction being linked to each other by means of coupling links (24, 26). With a lower overall volume and low use of materials, a jamming, in particular in view of thermal expansions and production tolerances, is to be avoided. For use with a radial-flow compressor, it is proposed to arrange the cranks (10) and the coupling links (24, 26) in an annular space (52) which neighbors the discharge port, into which space the pivot pins (8) parallel to the longitudinal axis (4) protrude with their free ends. All of the cranks (10) are arranged in a joint radial plane (53), the inner crank arm (14) being angled off with respect to the outer crank arm (12) by an angle (20) which is of the same size as the pitch angle (6). In this arrangement, crank pairs (28) are formed, the inner crank arms (10) of which are in each case angled off with respect to each other and the outer crank arms (12) of which are aligned in each case substantially parallel to each other.

10 Claims, 3 Drawing Sheets

ADJUSTING DEVICE FOR A COMPRESSOR

BACKGROUND OF THE INVENTION

The present invention relates to an adjusting device of a compressor with guide vanes arranged in the form of a ring around a longitudinal axis, which vanes are in each case fixedly connected to pivot pins to rotate therewith and are pivotally mounted in a housing, with two-armed cranks, which are in each case connected to one of the pivot pins, and with coupling links, which are in each case pivoted at corresponding crank arms of neighboring cranks, wherein the pivot pins and guide vanes are spaced apart in circumferential direction at uniform angular spacings and are jointly adjustable in the same direction.

An adjusting device for an axial-flow compressor is disclosed in U.S. Pat. No. 3,056,541, in which the cranks and the coupling links are arranged concentrically around the longitudinal axis of the axial-flow compressor on a cylindrical circumferential surface. All of the pivot pins of the guide vanes, which are arranged in front of the intake port of the axial-flow compressor, lie in a common radial plane. The cranks arranged cylindrically around the guide vanes are of straight design. In the case of an adjustment, the coupling links between the respectively adjacent cranks are moved along a multidimensional path, so that ball joints are necessary between the cranks and the coupling links. In an adjustment, forces which lie in the three mutually orthogonal directions in space have to be transferred. In view of the three-dimensional movement sequences, even small production inaccuracies can easily lead to faults, or even a jamming of the entire adjusting device. The coupling links are therefore designed to be adjustable in length, as a result of which a not inconsiderable space requirement and production outlay are necessary.

An adjusting device is known from European Pat. No. 43,017which has an adjusting ring arranged concentrically to the longitudinal axis of a radial-flow compressor for effecting common adjustments of the secondary guide vanes. A linkage lever is fixedly connected for rotation with each of the pivot pins and is provided at its other end with a slot. A bolt connected to the adjusting ring engages in this slot. When the adjusting ring is turned about the longitudinal axis of the radial-flow compressor, the pivot pin and the associated guide vane are pivoted via the respective bolt and linkage with the bolt being displaced in the slot. For large diameter radial-flow compressors, for example, devices with impeller diameters of one meter or more, correspondingly large dimensions result for an adjusting ring coaxial to the longitudinal axis. The production and storage of such a large adjusting ring presents considerable difficulties in practice. Furthermore, in view of the large dimensions of the adjusting ring, problems arise with regard to temperature behavior and thermal expansion. The space requirement is considerable, and difficulties arise in handling and assembly. Finally, it cannot be overlooked that in large radial-flow compressors, production and assembly of an adjusting ring coaxial to the impeller axis require a considerable cost outlay.

Furthermore, a device for adjusting swirl vanes of a turbo compressor is disclosed in German published application No. DE 24 03 113. The pivot pins are fixedly connected to rotate with the swirl vanes and each contain a gear wheel at the free end. All of the gear wheels are in engagement with a common adjustable gear ring. Difficulties arise with such a gear ring similar to those encountered with the adjusting ring described above, in particular with regard to thermal stresses, tolerances and cost of assembly. Particularly in relatively large compressors there is a risk of jamming and blocking the vanes.

SUMMARY OF THE INVENTION

The invention is based on the object of providing an improved adjusting device in which a functionally reliable adjustment of the guide vanes is made possible with a low constructional outlay. The adjusting device is to require a small overall volume and make possible a simple assembly in confined spaces on the discharge side. The jamming or even blocking of the adjusting device or of the guide vanes is to be reliably avoided and a high functional reliability is to be ensured under all operating conditions, particularly in view of thermal stresses and production tolerances. Furthermore, the adjusting device should not necessitate a larger overall volume for the radial-flow compressor, but should advantageously be capable of being arranged in an existing annular space on the discharge side in the vicinity of the diffuser. Complex components and component mountings with respect to the housing should be avoided as far as possible.

To achieve this object, it is proposed that in constructing a compressor as a radial-flow compressor, the guide vane adjusting cranks and coupling links are arranged in an annular space adjacent the discharge port of the compressor, that free ends of the pivot pins parallel to the longitudinal axis protrude into the aforementioned annular space, that the cranks are arranged in a radial plane with the axis of the radially inner crank arm disposed at an angle with respect to the axis of the radially outer crank arm which angle is equal in size to the angular spacing between cranks, and that, in circumferentially adjacent crank pairs in which the outer crank arms are each linked to each other by the coupling links, the inner crank arms are disposed at an angle with respect to each other, the outer crank arms of each said crank pair being aligned substantially parallel to each other.

The proposed adjusting device is characterized by a simple construction and ensures an extremely space-saving construction. The installation space available in the region of the diffuser of the radial-flow compressor can be used in a surprisingly simple way for arrangement and reception of the proposed cranks and coupling links. Instead of a large and complex control ring, only relatively small coupling links are provided for the mutual coupling of the circumferentially adjacent cranks. Circumferentially adjacent cranks are alternately connected to each other via the outer coupling link, which is pivotably connected to the outer crank arms of the crank pairs constructed in this manner, as well as via the second coupling link which is pivotably connected to the respective inner crank arms. The cranks are fixedly connected to the respective pivot pins to rotate therewith, whereby, in accordance with the invention, a releasable, adjustable connection is provided to facilitate mechanical adjustment of the guide vanes. As a result of the offset of the cranks in such a way that in each case the axis of the outer crank arm is disposed at an angle to the axis of the inner crank arm which is preferably the same as the angular spacing of adjacent cranks or guide vanes, a uniform adjustment of all of the guide vanes in the same direction is ensured. The thusly constructed crank pairs form parallel crank mechanisms in which, according to the invention, the outer crank arms are always parallel to each other. The pins or bolts by means of which the first coupling link is pivotably connected to the outer crank arms have the same spacing between each other as the pivot pins. Neighboring pairs are linked to each other in a corresponding manner by means of the second coupling link via the respective parallel aligned inner crank arms. Within the scope of the invention, the link pins of the second coupling link are also arranged at the same distance as adjacent pivot pins from each other.

It is consequently ensured that, for each crank pair, the outer crank arms are always parallel and furthermore in each case the inner crank arms linked to each other by the second coupling links are also parallel. Within the scope of this invention, the mutually corresponding cranks or their crank arms of the respective crank pairs are pivoted through the same angle with respect to the axial plane running through the respective pivot pins, depending on the respective adjustment angle of the guide vanes. The parallel aligned cranks and the coupling links are linked to each other in a very simple way by means of bolts. There are no large, difficult to handle components, but only comparatively small cranks, coupling links and bolts which can be produced and assembled with little effort. Also when designed and used as a Stirling motor (hot gas machine), a high functional reliability is achieved, especially since a uniform heating can be assumed for the adjusting device and also the vane spacing remains constant, as does the length of the coupling links with respect to one another.

Furthermore, it should be emphasized that the inner crank arm and the outer crank arm can in each case have the same crank length. All of the cranks are of the same design, but are arranged turned alternately through 180degrees on the pivot pins of adjacent guide vanes. The first and second coupling links are also of the same design, and the pivotable connection of the coupling links to the respective cranks also is effected by means of bolts of the same design. The adjusting device therefore basically contains only three differently designed components, i.e. two-armed cranks, coupling links and bolts, which results in considerable cost advantages in production. Even in the case of very large radialflow compressors, the impellers of which have diameters of several meters, the proposed adjusting device can be produced with low cost outlay, and a comparatively simple assembly also is ensured.

In an advantageous embodiment, the two-armed cranks are fixedly connected by means of a frictional connection to the respective pivot pins to rotate therewith. Thus, in assembly, the adjusting device can first be installed without initially having to pay heed to the respective pivot angle position of the pivot pins and guide vanes. Subsequently, the pivot angle position of the pivoting vanes can be set exactly and the frictional connection with the adjusting device or the two-armed crank can be established. A cone pressure connection with two conical interengaging sleeves biased toward each other has proved particularly advantageous. The housing of the radial-flow compressor has a bushshaped extension directed toward the annular space, through which each of the aforementioned pivot pins extends. The coupling links all lie in a common radial plane, which lies in front of the radial plane with the cranks. Like the cranks, the coupling links are designed in one piece, all of the coupling links, i.e. both the outer and the inner coupling links, being of identical design. cl

BRIEF DESCRIPTION OF THE DRAWINGS

The invention is explained in further detail hereinafter with reference to illustrative embodiments represented in the drawing, in which.

DETAILED DESCRIPTION OF PREFERRED EMBODIMENTS

Figure 1:
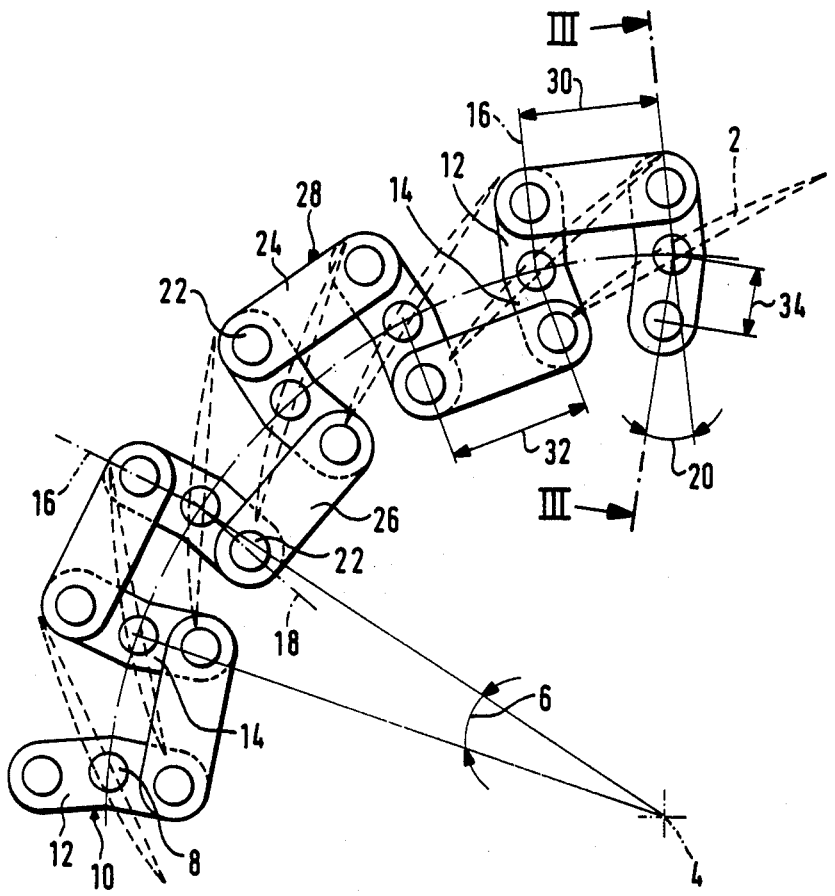
FIG. 1 shows a schematic view of the cranks and coupling links for opened guide vanes.

FIG.1. shows diagrammatically a part, in particular one quadrant, of the adjusting device for guide vanes 2 which are arranged spaced apart at an angular spacing or pitch angle 6 in a ring around a longitudinal axis 4. The guide vanes 2, here shown in broken lines for reasons of clarity, are arranged pivotally by means of pivot pins 8 in a housing of a radial-flow compressor. Connected fixedly in terms of rotation to each of the pivot pins 8 is a twoarmed crank 10. The cranks 10 each comprise an outer crank arm 12, directed in a radially outward direction, and a radially inwardly directed inner crank arm 14. Between the axis 16 of the outer crank arm 12 and the axis 18 of the inner crank arm 14 there is an angle 20 which is of the same size as the pitch angle 6.

The crank arm axes 16 and 18 in each case run through the pivot pin 8 and through bolts 22, by means of which the mutual pivot connection of neighboring cranks is formed through a first coupling link 24 or a second coupling link 26. Circumferentially adjacent cranks, the outer crank arms 12 of which are linked to each other by a first coupling link 24, are subsequently referred to as crank pair 28. For each crank pair, the distance 30 between the bolts 22, i.e. between their pivot axes, is the same size as the distance between the pivot pins 8 or their pivot axes. Thus, the axes 16 of the outer crank arms 12 of each crank pair 28 are always parallel regardless of the respective angular position.

The circumferentially adjacent crank pairs 28 are in each case coupled by means of the second coupling links 26, which are pivotably connected by means of bolts 22 to the inner crank arms 14. It should be mentioned merely for the sake of completeness that the cranks linked to each other in each case by the second coupling link can of course also be referred to as a crank pair. The second coupling link 26 has between the bolts 22 a distance 32 which again corresponds to the distance between the associated pivot pins 8 and consequently is the same size as the above-mentioned distance 30 of the coupling pair 28. Finally, the outer crank arms 12 and the inner crank arms 14 have the same crank length 34. Due to this proposed design and arrangement of the cranks and of the coupling links, it is ensured that the crank arms of neighboring cranks 10, interconnected by the respective coupling link, are always aligned parallel to each other. As can be seen, circumferentially adjacent cranks are in each case of the same design, the angle 20 corresponding to the angular spacing or pitch angle 6; neighboring cranks 10 are merely aligned such that they are turned through 180degrees with respect to each other in each case and are correspondingly connected to the pivot pins 8 of the associated guide vanes 2.

Figure 2:
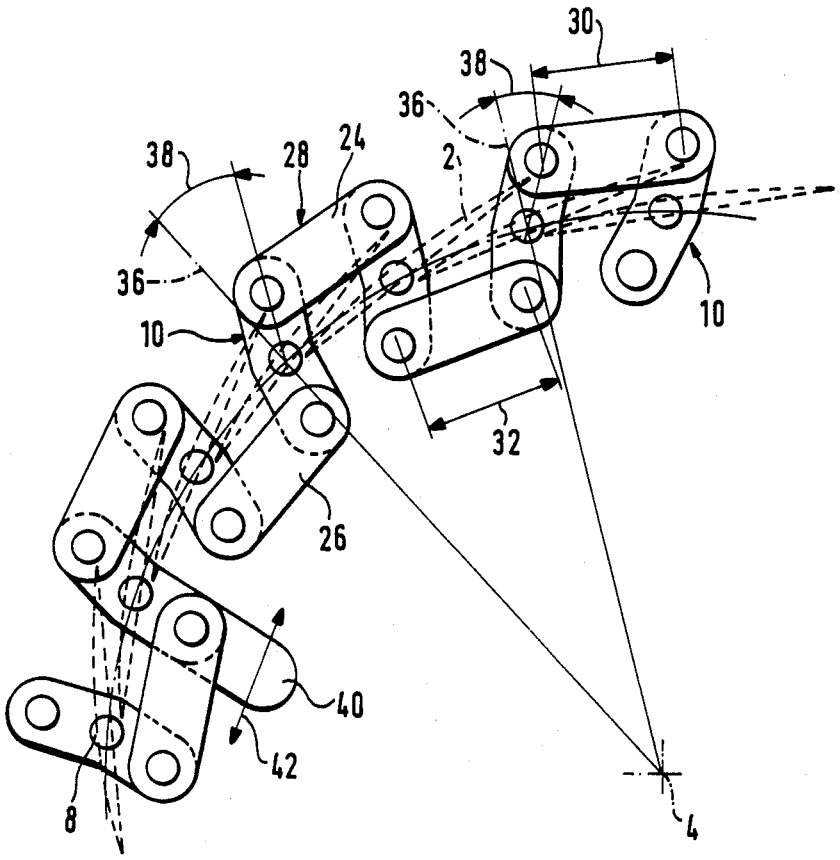
FIG. 2 shows a view similar to FIG. 1 but with substantially closed guide vanes.

FIG. 2 shows the adjusting device of FIG. 1 with the guide vanes 2 pivoted into the closed position. The cranks 10 are now pivoted through an angle 38 with respect to the axial plane 36 which extends in each case through the pivot pin 8. The cranks or crank arms corresponding to each other of the respective crank pairs 28 always assume the same angular position with respect to the respective axial plane 36, said position being adjustable in accordance with the respective angular position of the guide vanes. Since the distances 30 and 32 are of the same size in each case as the corresponding distances between the pivot axes of the guide vanes 2 predetermined by the pivot pins 8, the outer crank arms 12 of each crank pair 28 are likewise parallel like the inner crank arms 14 of the adjacent crank pairs 28. It should be stated expressly that all coupling links 26 are of identical design. The adjusting movement can be initiated for example via one of the cranks 10, which has an extension 40. To this crank extension 40 may be linked an adjusting lever or the like, by which the desired adjustment of the guide vanes 2 can be accomplished by movement in the direction of the arrow 42. In view of possible production tolerances, thermal expansions or the like, one of the coupling links may be omitted between two neighboring cranks at one point around the periphery of the device. Sluggish action or even jamming of the adjusting device is avoided. The "chain" formed by the cranks and the coupling links therefore does not have to be closed around the periphery, but according to the invention may be interrupted at one point. This makes production and also assembly easier, as a length compensation can take place at this open point. Disadvantages with regard to the setting accuracy of the guide vanes do not occur in view of the nonpositive connection between pivot pin and crank. The exact alignment of the guide vanes 2 does not take place until after complete assembly of the adjusting device with the cranks and the coupling links.

Figure 3:
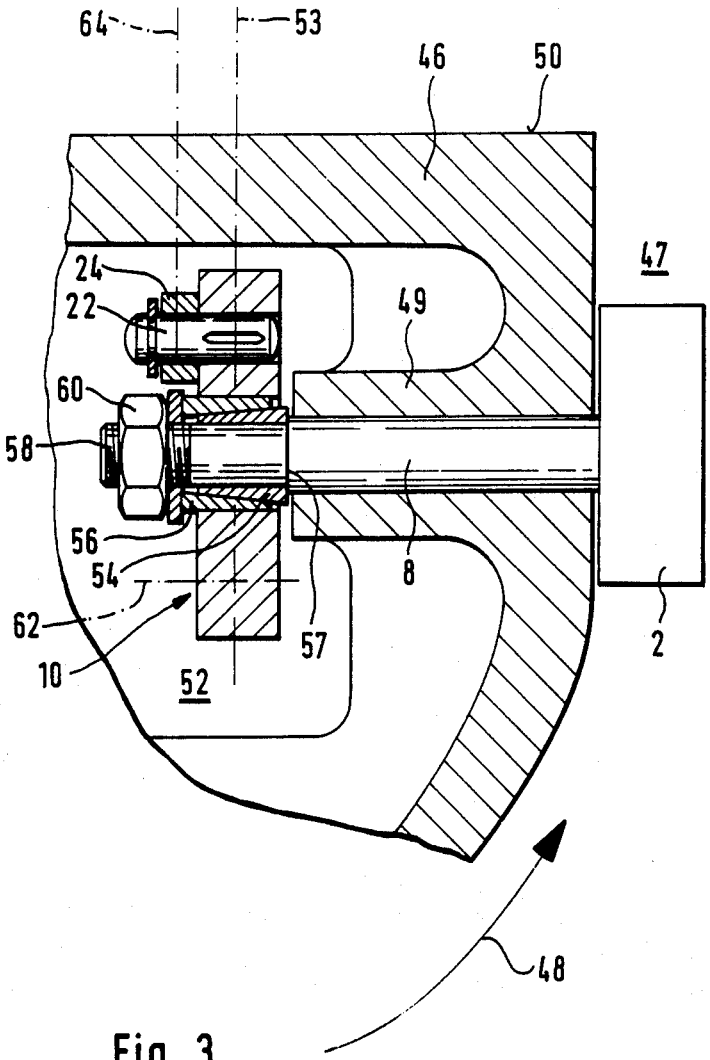
FIG. 3 shows a partial seotional view through the housing of a radial-flow compressor in an axial plane in the vicinity of the adjusting device. cl

FIG. 3 shows an enlarged sectional view taken through a part of a radial-flow compressor with the adjusting device in a substantially axial plane along the line III in FIG. 1. Shown here in a compressor housing 46 is the pressure-side secondary guide vane 2, which is mounted pivotally about the pivot pin 8 in the compressor housing 46. As indicated by the arrow 48, the medium flows to the guide vane 2 of the secondary guiding assembly to flow in the accustomed manner via the discharge port 47 into the spiral housing, which surrounds the compressor housing 46 in the region of the circumferential surface 50. The pivot pin 8 protrudes into an inner annular space 52 of the compressor housing 46, in which annular space 52, according to the invention, the adjusting device is arranged by utilizing the space available there. For the secure mounting of the respective pivot pin 8, the housing 46 has an advantageously bush-shaped extension 49, which protrudes into the annular space 52. Within the scope of this invention, the crank 10 is nonpositively connected to the pivot pin in the annular space 52. For reasons of clarity, only a single crank 10 is shown here, but all of the cranks of the adjusting device lie within the joint radial plane 53. This connection is designed here as a cone interference connection with two tapered sleeves 54, 56. The inner sleeve 54 bears on one side against an annular shoulder 57 of the pivot pin 8, while from the free other end the second conical sleeve 56 is pushed over the first conical sleeve 54. The pivot pin 8 has, at the free end, a thread 58 onto which a nut 60 is screwed, by means of which the two sleeves 54, 56 are urged against each other in order to establish the frictional or nonpositive connection of the crank 10. In the outer crank arm 12, the bolt 22 at which the first outer coupling link 24 is pivoted, is pressed in with a press fit. In the same way, the second coupling link is also pivoted at the inner lever arm of the crank 10, as is indicated by broken line 62. All of the coupling links, that is both the outer coupling links and the inner coupling links, of the adjusting device lie in the same common radial plane 64. When viewed in the direction of the free end of the pivot pin 8, this radial plane 64 lies in front of the radial plane 53 in which the cranks 10 are arranged. In view of the confined conditions in the annular space 52, the assembly of the adjusting device can be performed with a comparatively small effort, as no cumbersome large control rings, tooth segments, gear wheels or the like are necessary, but only the comparatively small parts of the adjusting device described above.

The foregoing description has been set forth merely to illustrate the invention and is not intended to be limiting. Since modifications of the described embodiments incorporating the spirit and substance of the invention may occur to person skilled in the art, the scope of the invention should be limited solely with reference to the appended claims and equivalents.

What is claimed is:

1. An adjusting device for a radial-flow compressor comprising a plurality of guide vanes arranged in a ring around a longitudinal axis, said vanes each being fixedly connected to a pivot pin an pivotally mounted in a housing, a plurality of two-armed cranks each connected to one of the pivot pins, and a plurality of coupling links each pivotably connected to corresponding crank arms of adjacent cranks, said pivot pins and guide vanes being circumferentially spaced apart at the same pitch angles and being jointly adjustable in the same direction, wherein the cranks and the coupling links are arranged in an annular space adjacent the discharge port of said compressor, the pivot pins are parallel to the longitudinal axis and protrude with their free ends into said annular space, the cranks are arranged in a radial plane, the axis of each radially inner crank arm is disposed at an angle with respect to the axis of the radially outer crank arm which angle is the same size as the pitch angle, the outer crank arms of circumferentially adjacent crank pairs are linked to each other by coupling links, the inner crank arms are disposed at an angle with respect to each other, and the outer crank arms of each crank pair are aligned substantially parallel to eachother.

2. An adjusting device according to claim 1, wherein the distances between the pivotable connection points of the respective crank arms are equal in size to the distance between the pivot axes of the pivot pins.

3. An adjusting device according to claim 1, wherein the coupling links are arranged in the annular space in a radial plane which, when viewed in the direction of the free end of the pivot pins, is in front of the radial plane in which the cranks are arranged.

4. An adjusting device according to claim 1, wherein the cranks are coupled to their respective pivot pins by means of a releasable frictional connection.

5. An adjusting device according to claim 4, wherein two interengaging conical sleeves are arranged on the pivot pin, one sleeve bearing against an annular shoulder of the pivot pin and the other sleeve being arranged inside a bore in the crank, said other sleeve being urged toward the one sleeve by means of a nut screwed onto a thread on the pivot pin.

6. An adjusting device according to claim 1, wherein there is no connection by means of a coupling link at one point of the periphery between two neighboring cranks.

7. An adjusting device according to claim 1, wherein all of the cranks are of identical design, circumferentially adjacent cranks being arranged on their respective pivot pins so as to be turned through 180. with respect to each other.

8. An adjusting device according to claim 1, wherein the crank lengths of the outer crank arm are of the same size as of the inner crank arm.

9. An adjusting device according to claim 1, wherein the overall length of each of the outer and inner coupling links is substantially equal to the length of each of the two-armed cranks.

10. An adjusting device according to claim 1, wherein the outer and the inner coupling links are each designed as one piece and are pivotably connected via a bolt with a cylindrical bearing surface to the cranks, and wherein the outer coupling links and the inner coupling links are of the same design.

* * * * *